US009982572B2

(12) United States Patent
Simpson

(10) Patent No.: US 9,982,572 B2
(45) Date of Patent: May 29, 2018

(54) POSITIONAL CONTROL OF ACTUATOR SHAFT FOR E-PHASER AND METHOD OF CALIBRATION

(71) Applicant: BorgWarner Inc., Auburn Hills, MI (US)

(72) Inventor: Roger T. Simpson, Ithaca, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 12 days.

(21) Appl. No.: 14/902,625

(22) PCT Filed: Jul. 7, 2014

(86) PCT No.: PCT/US2014/045550
§ 371 (c)(1),
(2) Date: Jan. 4, 2016

(87) PCT Pub. No.: WO2015/006197
PCT Pub. Date: Jan. 15, 2015

(65) Prior Publication Data

US 2016/0186618 A1 Jun. 30, 2016

Related U.S. Application Data

(60) Provisional application No. 61/844,575, filed on Jul. 10, 2013.

(51) Int. Cl.
*F01L 1/344* (2006.01)
*F01L 1/352* (2006.01)
(Continued)

(52) U.S. Cl.
CPC ..... *F01L 1/344* (2013.01); *F01L 1/047* (2013.01); *F01L 1/352* (2013.01); *F01L 9/04* (2013.01);
(Continued)

(58) Field of Classification Search
CPC ..... F01L 1/047; F01L 9/04; F01L 1/34; F01L 1/344; F01L 1/352; F01L 1/348;
(Continued)

(56) References Cited

U.S. PATENT DOCUMENTS 5,033,431 A * 7/1991 Poirier ..... F02D 11/10 123/339.24
5,680,837 A * 10/1997 Pierik ..... F01L 1/352 123/90.17

(Continued)

OTHER PUBLICATIONS

Erjavec, Automatic Transmissions, 2004, Thomson Delmar Learning, Chapter 5, pp. 42-43.*

*Primary Examiner* — Phutthiwat Wongwian
*Assistant Examiner* — Loren Edwards

(57) ABSTRACT

An apparatus (10) and method for controlling an angular position of a camshaft (12) in an internal combustion engine having a camshaft phaser (14) for controllably varying the phase relationship between a crankshaft of the internal combustion engine and the camshaft (12). The camshaft phaser (14) can be actuated by an electric motor (16) having an actuator shaft (18) operating through a gear reduction drive train (20) having a stationary adjusting member (22) which rotates when a phase change adjustment is desired. A sensor (30) can generate a signal corresponding to an angular position of the stationary adjusting member (22) of the gear reduction drive train (20). An engine control unit (40) can adjust a position of the camshaft (12) through operation of the electric motor (16) for rotating the stationary adjusting member (22) based on the generated signal corresponding to the angular position of the stationary adjusting member (22).

15 Claims, 6 Drawing Sheets

(51) Int. Cl.
*F01L 1/047* (2006.01)
*F01L 9/04* (2006.01)
*F01L 13/00* (2006.01)

(52) U.S. Cl.
CPC ..... *F01L 2013/103* (2013.01); *F01L 2250/02* (2013.01); *F01L 2250/04* (2013.01); *F01L 2250/06* (2013.01); *F01L 2800/09* (2013.01); *F01L 2820/041* (2013.01); *F01L 2820/042* (2013.01)

(58) Field of Classification Search
CPC . F01L 13/00; F01L 2013/103; F01L 2250/02; F01L 2250/04; F01L 2250/06; F01L 2800/09; F01L 2820/041; F01L 2820/042
USPC ..... 123/90.15, 90.16, 90.11
See application file for complete search history.

(56) References Cited

U.S. PATENT DOCUMENTS

| | | | | |
|---|---|---|---|---|
| 6,848,401 | B2 * | 2/2005 | Takenaka | F01L 1/352 123/90.11 |
| 7,926,457 | B2 * | 4/2011 | Nowak | F01L 1/024 123/90.16 |
| 8,165,785 | B2 * | 4/2012 | Mashiki | F01L 1/352 123/90.15 |
| 2010/0218738 | A1 * | 9/2010 | Ai | F01L 1/02 123/90.17 |

* cited by examiner

POSITIONAL CONTROL OF ACTUATOR SHAFT FOR E-PHASER AND METHOD OF CALIBRATION

FIELD OF THE INVENTION

The invention relates to sensing a position of a camshaft in an internal combustion engine which includes an electric variable cam phaser, and more particularly to a positional control system for an actuator shaft of an electrically operated cam phaser with a feedback loop and a method of calibration.

BACKGROUND

The operation of an electric phaser for a cam phasing system is such that a sun gear or planet gear carrier is stationary, and a ring gear and other member rotates with a camshaft, which is driven by a crank through a gear, belt or chain system. One method of control is to use a first position sensor mounted on the crankshaft and a second position sensor mounted on the camshaft. After the cam is rotating, the angular position of the cam can be calculated by an electronic control unit (ECU) and a signal can be sent to move the stationary member to adjust the phaser angle of the cam, for example, see U.S. Pat. No. 5,680,837. Other control systems can be seen in U.S. Pat. No. 7,640,907; and U.S. Pat. No. 7,243,627.

U.S. Published Patent Application No. 2012/0053817 discloses a method for sensing the position of a camshaft in an internal combustion engine having a camshaft phaser for controllably varying the phase relationship between a crankshaft of the internal combustion engine and the camshaft, where the camshaft phaser is actuated by an electric motor and includes a gear reduction mechanism with a predetermined gear reduction ratio and rotational position means for determining the rotational position of the electric motor. The method includes generating a rotational position signal indicative of the rotational position of the electric motor by using the rotational position means to determine the rotational position of the electric motor, and calculating the position of the camshaft based on the rotational position signal and the gear reduction ratio of the gear reduction mechanism. The rotational position means includes three Hall Effect sensors, one sensor disposed between each of the three electrical windings in the stator of the motor, for generating a rotational position signal indicative of the rotational position of the rotor. The published application asserts that this method can also be used to detect the position of the rotor even at zero revolutions per minute (RPM) as long as the engine control module (ECM) is still powered on. The disclosure further asserts that using Hall Effect sensors to determine the position of the camshaft, through the mathematical equations corresponding to the attached harmonic gear drive unit, eliminates the need for a separate sensor for determining the position of the camshaft. While the disclosed configuration may be suitable for the intended purpose, the complexity of the sensor configuration increases cost of the motor and potentially raises issues regarding the simplicity of assembly and/or initialization of the assembled motor system.

SUMMARY

It would be desirable to know the position of a stationary member of a gear reduction drive train, or an actuator shaft of the stationary member, prior to initial cranking of an internal combustion engine. It would be desirable to be able to determine the position of a stationary member of a gear reduction drive train, or an actuator shaft of the stationary member, with a low cost, simple assembly interacting with a stationary member of a gear reduction drive train, or an actuator shaft of the stationary member, of a cam phaser. It would be desirable to move the cam to a new position prior to the engine spinning for varying conditions of the engine and vehicle for improved start (time and harshness) and reduced emissions. As such, knowing the position of the stationary camshaft member allows repositioning of the cam accurately prior to initial engine cranking.

An apparatus and method for controlling an angular position of a camshaft in an internal combustion engine having a camshaft phaser for controllably varying the phase relationship between a crankshaft of the internal combustion engine and the camshaft. The camshaft phaser can be actuated by an electric motor having an actuator shaft operating through a gear reduction drive train having a stationary adjusting member which rotates when a phase change adjustment is desired. A sensor can generate a signal corresponding to an angular position of the stationary adjusting member of the gear reduction drive train. An engine control unit can adjust a position of the camshaft through operation of the electric motor for rotating the stationary adjusting member based on the generated signal corresponding to the angular position of the stationary adjusting member.

A method can control an angular position of a camshaft in an internal combustion engine having a camshaft phaser for controllably varying the phase relationship between a crankshaft of the internal combustion engine and the camshaft. The camshaft phaser can be actuated by an electric motor having an actuator shaft operating through a gear reduction drive train having a stationary adjusting member which rotates when a phase change adjustment is desired. A signal can be generated corresponding to an angular position of the stationary adjusting member of the gear reduction drive train with a sensor, and a position of the camshaft can be adjusted through operation of the electric motor for rotating the stationary adjusting member based on the generated signal corresponding to the angular position of the stationary adjusting member with an engine control unit.

A method can control an angular position of a camshaft in an internal combustion engine having a camshaft phaser for controllably varying the phase relationship between a crankshaft of the internal combustion engine and the camshaft. The camshaft phaser can be actuated by an electric motor having an actuator shaft operating through a gear reduction drive train having a stationary adjusting member which rotates when a phase change adjustment is desired. A position of the stationary member can be controlled while running the internal combustion engine by commanding the stationary member to move toward a position in response to a cam phase adjustment signal, adjusting the stationary member position toward the commanded position, receiving a stationary member position sensor signal, and determining if the stationary member is in the commanded position. If not in the commanded position, the method can continue movement toward the commanded position. If in the commanded position, the method can receive a camshaft position sensor signal and a crankshaft position sensor signal, and determine if the stationary member position sensor signal, camshaft position sensor signal, and crankshaft position sensor signal are consistent with one another. If consistent with one another, the method can wait for another cam phase adjustment command. If not consistent with one another, the method can recalibrate the stationary member position and continuing movement of the stationary member toward the commanded position.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
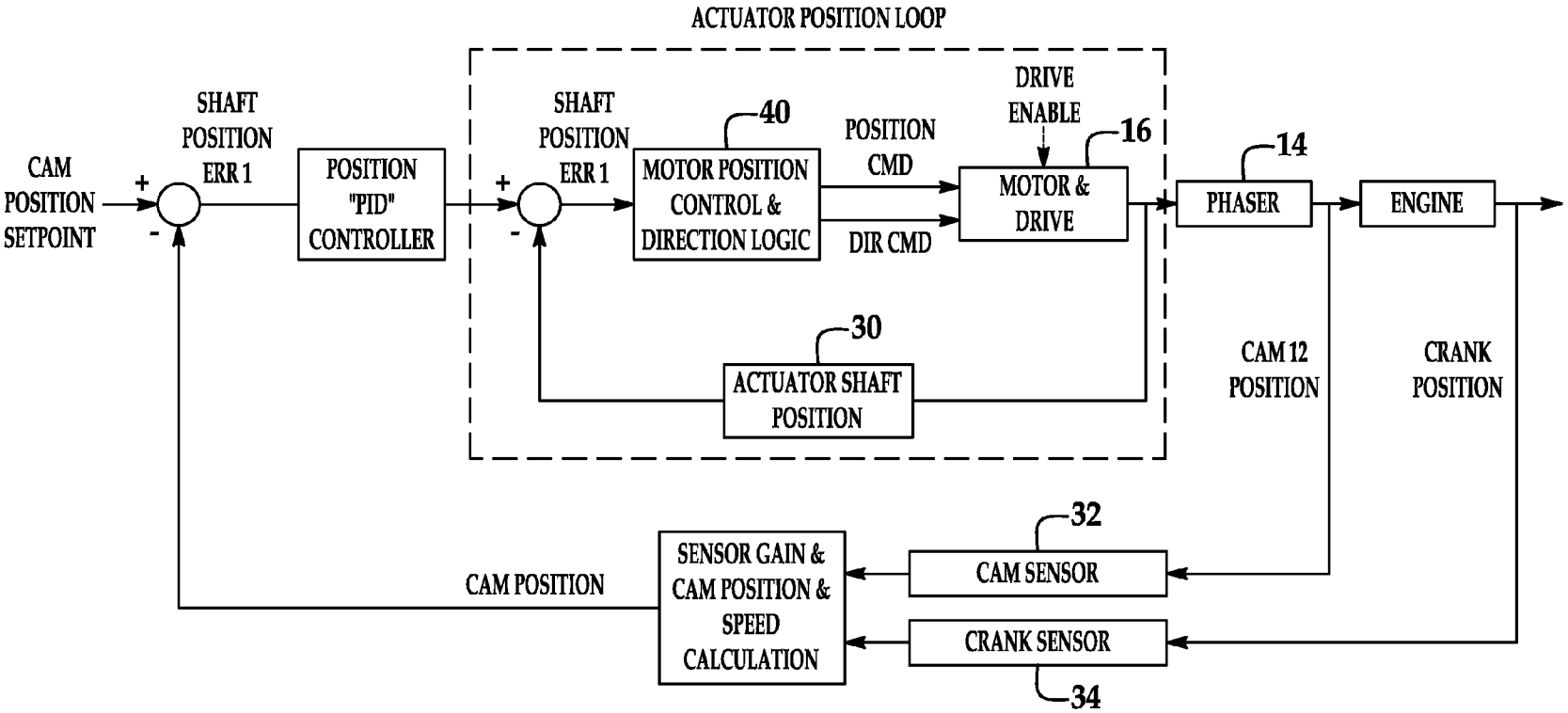
FIG. 1 is a schematic view of an electric phaser controller diagram with actuator position loop for a stationary member of a gear reduction drive train in a phaser positional control system and a method of calibration.
Figure 2:
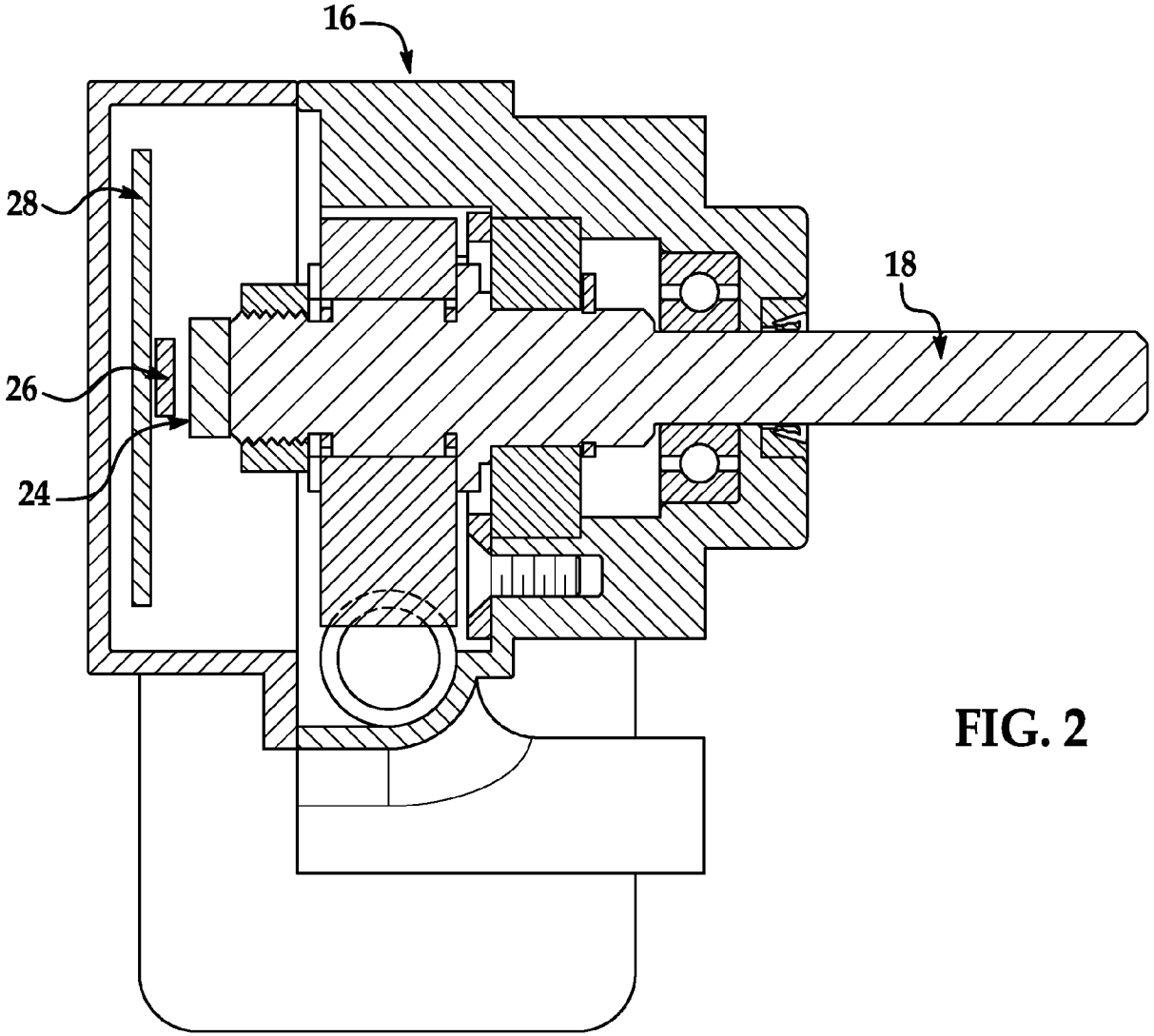
FIG. 2 is a simplified cross sectional view of a positional control system for an actuator shaft of an electric phaser.

Referring now to FIGS. 1-3C, a device and method is illustrated for controlling an angular position of a camshaft 12 in an internal combustion engine having a camshaft phaser 14 for controllably varying the phase relationship between a crankshaft of the internal combustion engine and the camshaft. The camshaft phaser 14 can be actuated by an electric motor 16 having an actuator shaft 18 operating through a gear reduction drive train 20 with a stationary adjusting member 22 which rotates when a phase change adjustment is desired. The method can include generating a signal corresponding to an angular position of the stationary adjusting member 22 of the gear reduction drive train 20 with a sensor 30, and adjusting a position of the camshaft 12 through operation of the electric motor 16 for rotating the stationary adjusting member 22 based on the generated signal corresponding to the angular position of the stationary adjusting member 22 with an engine control unit 40. As illustrated in FIG. 2, the actuator shaft 18 can be driven by an electric motor 16. The actuator shaft 18 can include a magnet 24 interacting with a sensor 26 in communication with a printed circuit board (PCB) 28 for signaling an angular position of the actuator shaft 18.

Figure 3A:
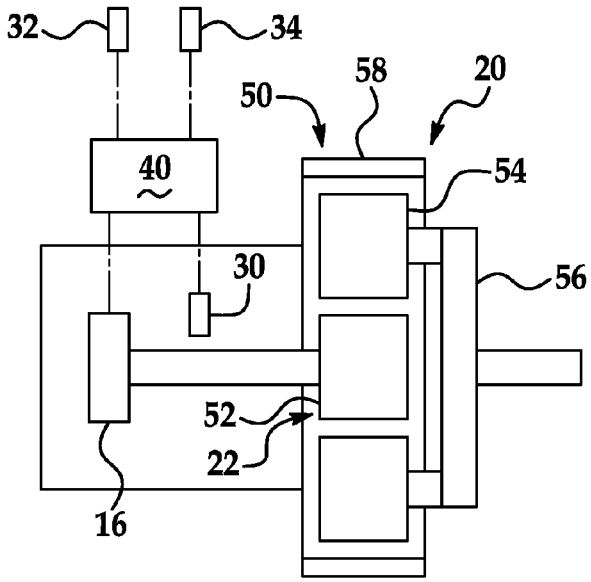
FIG. 3A is a simplified schematic view of a gear reduction drive train having a stationary member with a sensor generating a signal corresponding to a position of the stationary member to an electronic control unit for controlling the electric motor connected to the stationary member for adjustment of a camshaft phase position, wherein the stationary member is a sun gear.

Referring now to FIG. 3A, the gear reduction drive train 20 can include an assembly of a planetary gear system or assembly 50 having a sun gear 52, a plurality of planet gears 54 rotationally engaging the sun gear 52 and supported for synchronized rotation about the sun gear 52 with a carrier 56. A ring gear 58 can rotationally engage the plurality of planet gears 54 and can have an axis of rotation coaxial with the sun gear 52 and carrier 56. The sun gear 52 in this configuration can define the stationary adjusting member 22.

Figure 3B:
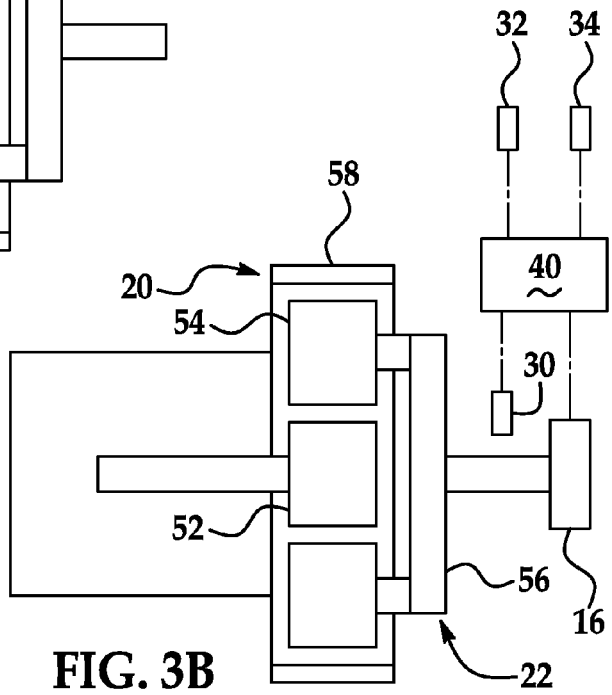
FIG. 3B is a simplified schematic view of a gear reduction drive train having a stationary member with a sensor generating a signal corresponding to a position of the stationary member to an electronic control unit for controlling the electric motor connected to the stationary member for adjustment of a camshaft phase position, wherein the stationary member is a planet gear carrier.

Referring now to FIG. 3B, the gear reduction drive train 20 can include an assembly of a planetary gear system or assembly 50 having a sun gear 52, a plurality of planet gears 54 rotationally engaging the sun gear 52 and supported for synchronized rotation about the sun gear 52 with a carrier 56. A ring gear 58 can rotationally engage the plurality of planet gears 54 and can have an axis of rotation coaxial with the sun gear 52 and carrier 56. The carrier 56 in this configuration can define the stationary adjusting member 22.

Figure 3C:
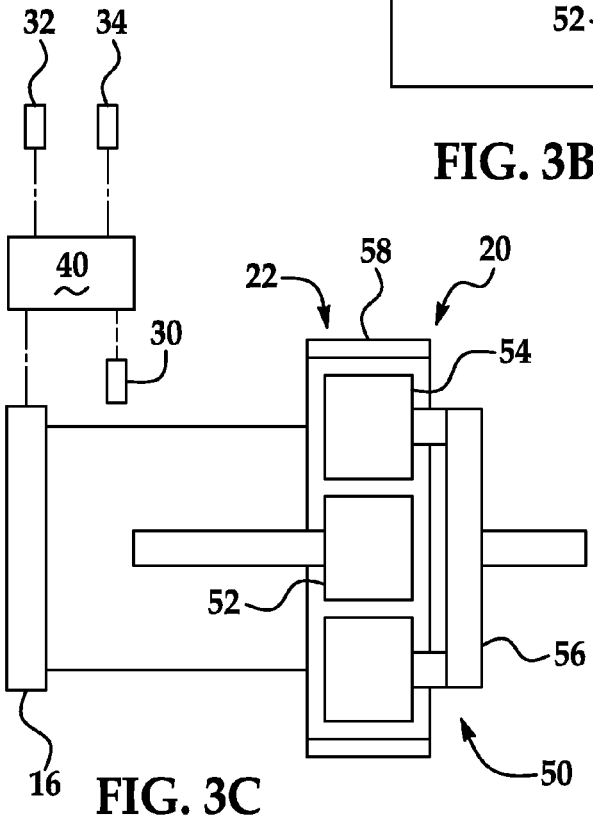
FIG. 3C is a simplified schematic view of a gear reduction drive train having a stationary member with a sensor generating a signal corresponding to a position of the stationary member to an electronic control unit for controlling the electric motor connected to the stationary member for adjustment of a camshaft phase position, wherein the stationary member is a ring gear.

Referring now to FIG. 3C, the gear reduction drive train 20 can include an assembly of a planetary gear system or assembly 50 having a sun gear 52, a plurality of planet gears 54 rotationally engaging the sun gear 52 and supported for synchronized rotation about the sun gear 52 with a carrier 56. A ring gear 58 can rotationally engage the plurality of planet gears 54 and can have an axis of rotation coaxial with the sun gear 52 and carrier 56. The ring gear 58 in this configuration can define the stationary adjusting member 22.

Figure 4:
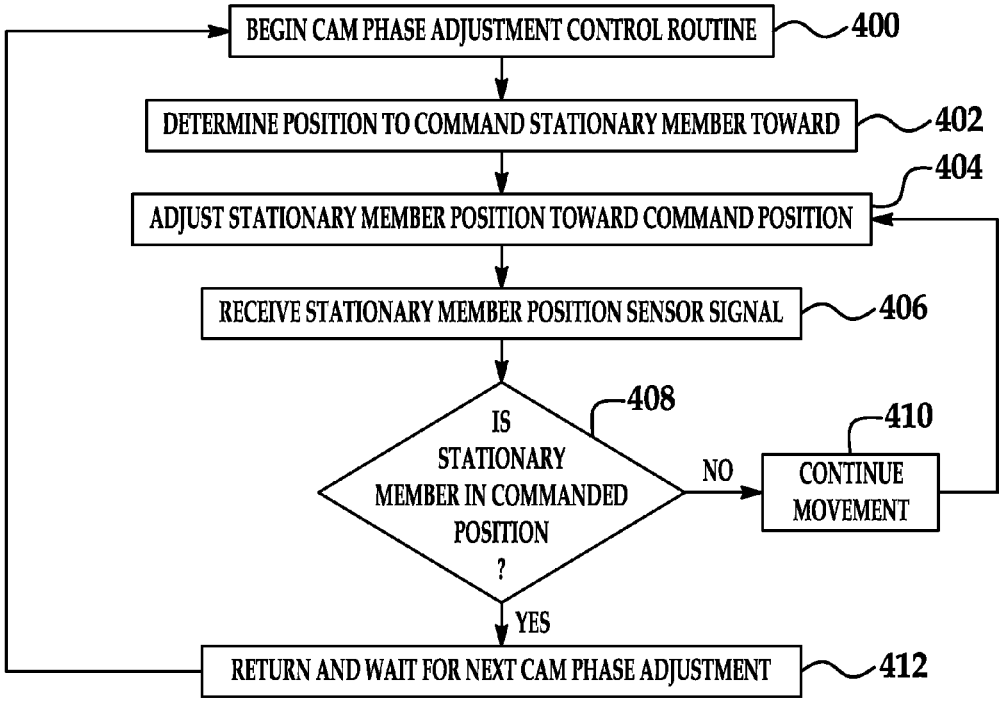
FIG. 4 is a simplified control diagram for driving the stationary member of the gear reduction drive train toward a commanded position with a position feedback signals from the stationary member.

Referring now to FIG. 4, a method or control program for controlling 400 a position of the stationary adjusting member 22 can include determining 402 a position to command the stationary adjusting member 22 to move toward in response to a cam phase adjustment signal. The stationary adjusting member 22 can be adjusted 404 toward the commanded position. A position sensor 30 for the stationary adjusting member 22 generates a signal that can be received 406. Query 408 determines if the stationary adjusting member 22 is in the commanded position. If the stationary adjusting member 22 is not in the commanded position, movement toward the commanded position is continued in step 410. If the stationary adjusting member 22 is in the commanded position, the method returns to the beginning and waits 412 for the next cam phase adjustment signal to be received.

Figure 5:
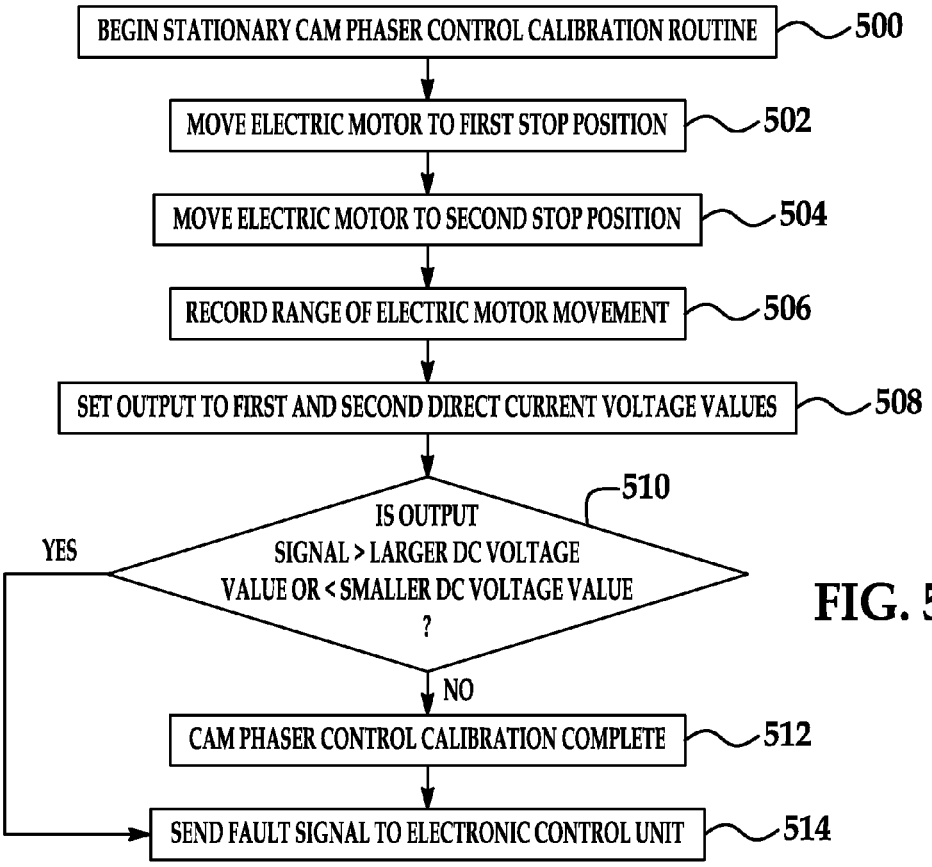
FIG. 5 is a simplified control diagram for calibrating the stationary member of the gear reduction drive train without running the internal combustion engine.

Referring now to FIG. 5, a calibration program 500 is illustrated for calibrating a position of the stationary adjusting member 22 without running the internal combustion engine. The calibration program 500 can including moving 502 the electric motor 16 to a first stop position. The electric motor 16 is then moved 504 to a second stop position. A range of the electric motor movement is recorded 506. The calibration program 500 then sets 508 a output of the position sensor 30 to first and second direct current voltage values corresponding to the first and second stop positions.

Figure 6:
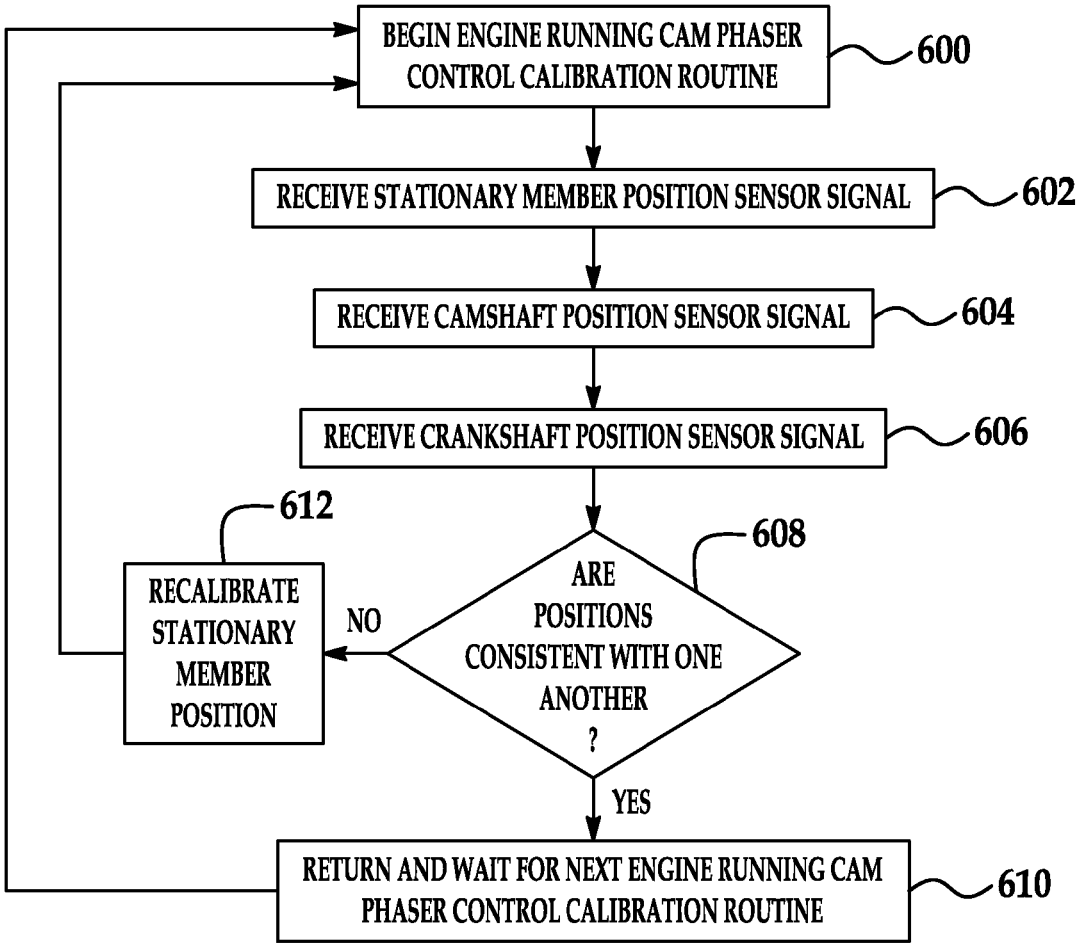
FIG. 6 is a simplified control diagram for calibrating the stationary member of the gear reduction drive train while running the internal combustion engine.

Referring now to FIG. 6, a calibration program 600 is illustrated for calibrating a position of the stationary adjusting member 22 while running the internal combustion engine. The calibration program 600 can include receiving 602 a signal from a position sensor 30 associated with stationary adjusting member 22. A signal can be received 604 from a camshaft position sensor 32. A signal can also be received 606 from a crankshaft position sensor 34. Query 608 can determine if the signaled positions are consistent with one another. If the signaled positions are consistent with one another, the calibration program waits 610 for another cam phase adjustment command. If the signaled positions are not consistent with one another, the calibration program recalibrates 612 the stationary adjusting member 22 position and rechecks the signals from position sensors 30, 32, 34 for consistency.

Figure 7:
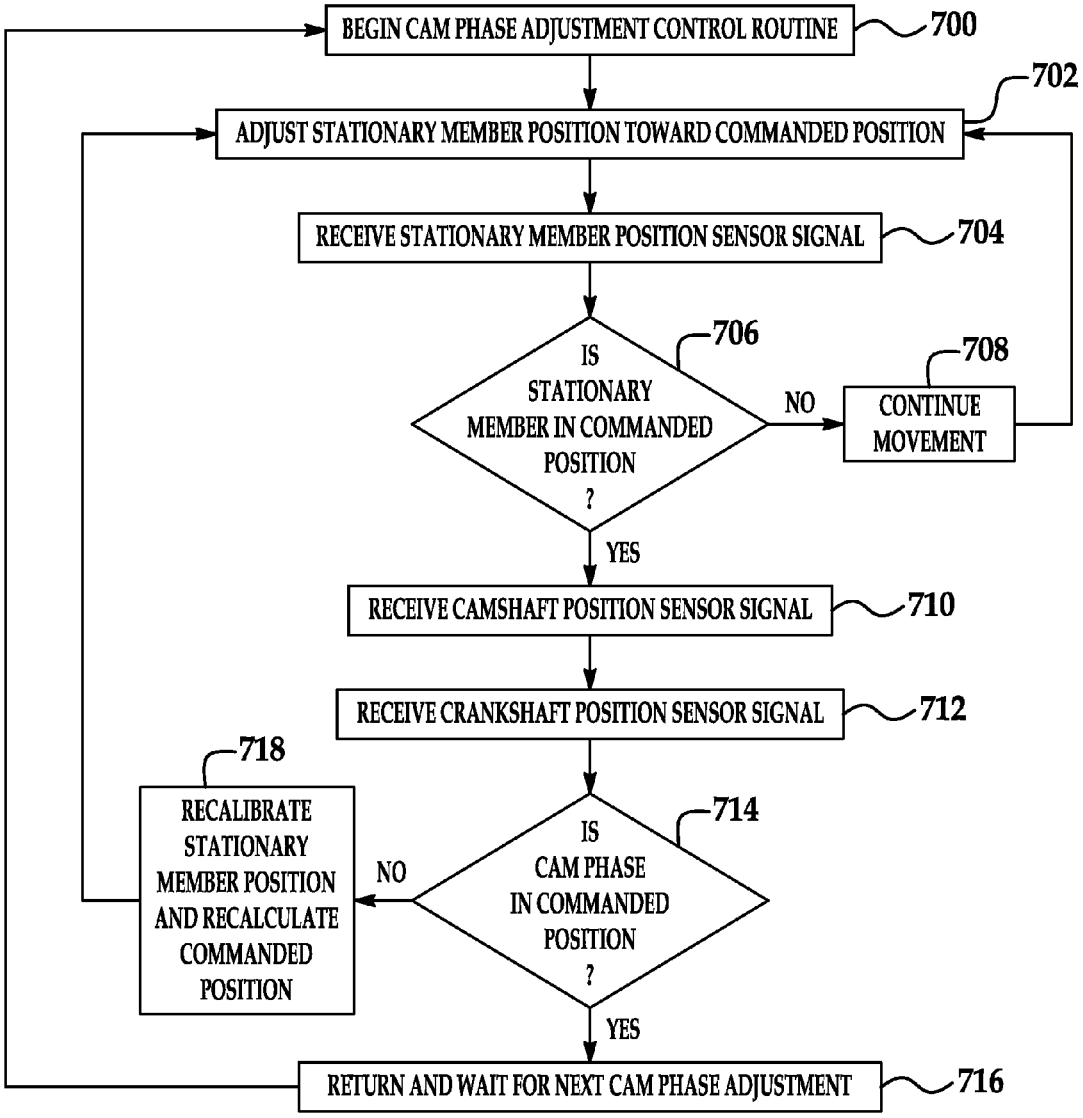
FIG. 7 is a simplified control diagram for driving the stationary member of the gear reduction drive train toward a commanded position with a position feedback signal from the stationary member defining an internal control loop, and feedback signals from a camshaft sensor and a crankshaft sensor defining an external control loop for calibrating a position of the stationary member while the internal combustion engine is running.

Referring now to FIG. 7, a method or control program is illustrated for controlling an angular position of a camshaft 12 in an internal combustion engine having a camshaft phaser 14 for controllably varying the phase relationship between a crankshaft of the internal combustion engine and the camshaft. The camshaft phaser 14 can be actuated by an electric motor 16 having an actuator shaft 18 operating through a gear reduction drive train 20 with a stationary adjusting member 22 which rotates when a phase change adjustment is desired. The method or control program can include controlling 700 a position of the stationary adjusting member 22 while running the internal combustion engine. The method can involve moving 702 the stationary adjusting member 22 toward a commanded position in response to a cam phase adjustment signal. A signal is received 704 from a stationary adjusting member 22 position sensor 30 signal. The control program or method determines 706 if the stationary adjusting member 22 is in the commanded position. If the stationary adjusting member 22 is not in the commanded position, the control program or method continues 708 movement of the stationary adjusting member 22 toward the commanded position. If the stationary adjusting member 22 is in the commanded position, the control program or method receives 710, 712 a camshaft position sensor 32 signal and a crankshaft position sensor 34 signal. The control program or method determines 714 if the stationary member position sensor 30 signal, camshaft position sensor 32 signal, and crankshaft position sensor 34 signal are consistent with one another. If the signals from the sensors 30, 32, 34 are consistent with one another, the control program or method waits 716 for another cam phase adjustment command. If the signals form the sensors 30, 32, 34 are not consistent with one another, the control program or method recalibrates 718 the stationary adjusting member 22 position and continues movement of the stationary adjusting member 22 toward the commanded position.

The operation of an electric phaser for a cam phasing system is such that a sun gear or planet gear carrier is stationary, and a ring gear and other member rotates with a camshaft, which is driven by a crank through a gear, belt or chain system. One method of control is to use a first position sensor mounted on the crankshaft and a second position sensor mounted on the camshaft. After the cam is rotating, the angular position of the cam can be calculated by an electronic control unit (ECU) and a signal can be sent to move the stationary member to adjust the phaser angle of the cam.

An improvement is provided by mounting an angular position sensor with respect to the stationary member of the gear reduction drive train, such that an output signal corresponds to the position of the stationary member. The angular position sensor can be mounted on the stationary member, or on an actuator shaft that moves the stationary member. Accordingly, the position of a stationary member of a gear reduction drive train, or an actuator shaft of the stationary member, can be known prior to initial cranking of an internal combustion engine. The position of a stationary member of a gear reduction drive train, or an actuator shaft of the stationary member, can be determined with a low cost, simple assembly interacting with a stationary member of a gear reduction drive train, or an actuator shaft of the stationary member, of a cam phaser. As a result of knowing the current position of the stationary member of a gear reduction train drive, or an actuator shaft of the stationary member, the cam can be moved to a new position prior to the engine spinning for varying conditions of the engine and vehicle for improved start (time and harshness) and reduced emissions. Accordingly, knowledge regarding the position of the stationary camshaft member allows repositioning of the cam accurately prior to initial engine cranking.

By way of example and not limitation, a Hall Effect sensor can be located across from an end of a worm gear motor actuator shaft and a magnet can be mounted to the end of the actuator shaft. This will give an output to the Electronic Control Unit (ECU), or Proportional-Integral-Derivative (PID) controller, to control the position of the shaft. Other sensors known in the industry can be used if desired, by way of example and not limitation, such as non-contact analog position sensor. The actuator position loop allows the actuator to move in response to the setpoint change and then fine tune the cam phaser angle by determining the phaser position by using the cam position sensor and crank position sensor.

Due to tolerance stack up the angular position sensor can have a slight error with respect to the actual position of the shaft. A calibration procedure can be performed for improved accuracy of the angular position of the shaft. One such calibration is to move the motor to the stops, record the range and set the output to 0.5 VDC to 0.45 VDC. This range is selected so that if the output signal is at either OVDC or 5 VDC a fault signal will be sent to the engine controller.

Once the actuator is mounted in the engine and the engine is running a second calibration can be performed similar to the above mentioned calibration only this time the phase angle of the cam and crank position signal can be used to calibrate the position of the actuator shaft. This would help reduce any inaccuracies in the fixed member and other gear train members.

For the control of the phaser position there will be an inner control loop used for feed forward to adjust the position of the actuator to the commanded position quickly and then have an outer control loop using the cam and crank position sensor to finely adjust the phaser position. This will improve the phaser response allowing the phaser to have quick response and accurate positional control.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method for controlling an angular position of a camshaft (12) in an internal combustion engine having a camshaft phaser (14) for controllably varying a phase relationship between a crankshaft of the internal combustion engine and the camshaft, the camshaft phaser (14) being actuated by an electric motor (16) having an actuator shaft (18) operating through a gear reduction drive train (20) having a stationary adjusting member (22) which rotates when a phase change adjustment is desired but is stationary when the phase relationship between the crankshaft and the camshaft is maintained, the method comprising:

generating a signal corresponding to an angular position of the stationary adjusting member (22) of the gear reduction drive train (20) with a sensor (30) that is configured to detect camshaft position prior to engine operation and is positioned with respect to the stationary adjusting member (22) so that it detects the angular position of the stationary adjusting member (22); and adjusting a position of the camshaft (12) through operation of the electric motor (16) for rotating the stationary adjusting member (22) based on the generated signal received from the sensor (30) corresponding to the angular position of the stationary adjusting member (22) with an engine control unit (40).

2. The method of claim 1, wherein the gear reduction drive train (20) further comprises:

assembling a planetary gear system (50) having a sun gear (52), a plurality of planet gears (54) rotationally engaging the sun gear (52) and supported for synchronized rotation about the sun gear (52) with a carrier (56), and a ring gear (58) rotationally engaging the plurality of planet gears (54) and having an axis of rotation coaxial with the sun gear (52) and carrier (56), wherein the sun gear (52) defines the stationary adjusting member (22).

3. The method of claim 1, wherein the gear reduction drive train (20) further comprises:

assembling a planetary gear system (50) having a sun gear (52), a plurality of planet gears (54) rotationally engaging the sun gear (52) and supported for synchronized rotation about the sun gear (52) with a carrier (56), and a ring gear (58) rotationally engaging the plurality of planet gears (54) and having an axis of rotation coaxial with the sun gear (52) and carrier (56), wherein the carrier (56) defines the stationary adjusting member (22).

4. The method of claim 1, wherein the gear reduction drive train (20) further comprises:

assembling a planetary gear system (50) having a sun gear (52), a plurality of planet gears (54) rotationally engaging the sun gear (52) and supported for synchronized rotation about the sun gear (52) with a carrier (56), and a ring gear (58) rotationally engaging the plurality of planet gears (54) and having an axis of rotation coaxial with the sun gear (52) and carrier (56), wherein the ring gear (58) defines the stationary adjusting member (22).

5. The method of claim 1 further comprising:

calibrating (500) a position of the stationary adjusting member (22) without running the internal combustion engine including:

moving (502) the electric motor (16) to a first stop position;

moving (504) the electric motor (16) to a second stop position;

recording (506) a range of the electric motor movement; and setting (508) position sensor (30) output to first and second direct current voltage values corresponding to the first and second stop positions.

6. The method of claim 1 further comprising:

calibrating (600) a position of the stationary adjusting member (22) while running the internal combustion engine including:

receiving (602) a stationary adjusting member (22) position sensor (30) signal;

receiving (604) a camshaft position sensor (32) signal;

receiving (606) a crankshaft position sensor (34) signal;

determining (608) if positions are consistent with one another;

if consistent, waiting (610) for another cam phase adjustment command; and if not consistent, recalibrating (612) the stationary adjusting member (22) position and rechecking position sensor (30, 32, 34) signals for consistency.

7. The method of claim 1 further comprising:

controlling (400) a position of the stationary adjusting member (22) including:

determining (402) a position to command the stationary adjusting member (22) to move toward in response to a cam phase adjustment signal;

adjusting (404) the stationary adjusting member (22) toward the commanded position;

receiving (406) a stationary adjusting member (22) position sensor (30) signal;

determining (408) if the stationary adjusting member (22) is in the commanded position;

if not in the commanded position, continuing (410) movement toward the commanded position; and if in the commanded position, waiting (412) for another cam phase adjustment signal.

8. In an apparatus (10) for controlling an angular position of a camshaft (12) in an internal combustion engine having a camshaft phaser (14) for controllably varying a phase relationship between a crankshaft of the internal combustion engine and the camshaft (12), the camshaft phaser (14) being actuated by an electric motor (16) having an actuator shaft (18) operating through a gear reduction drive train (20) having a stationary adjusting member (22) which rotates when a phase change adjustment is desired but is stationary when the phase relationship between the crankshaft and the camshaft is maintained;

a sensor (30), positioned with respect to the stationary adjusting member (22) so that it is configured to detect the angular position of the stationary adjusting member (22) prior to engine operation, generating a signal corresponding to an angular position of the stationary adjusting member (22) of the gear reduction drive train (20); and an engine control unit (40) for adjusting a position of the camshaft (12) through operation of the electric motor (16) for rotating the stationary adjusting member (22) based on the generated signal received from the sensor (30) that corresponds to the angular position of the stationary adjusting member (22).

9. The apparatus (10) of claim 8 further comprising:

a planetary gear assembly (50) having a sun gear (52), a plurality of planet gears (54) rotationally engaging the sun gear (52) and supported for synchronized rotation about the sun gear (52) with a carrier (56), and a ring gear (58) rotationally engaging the plurality of planet gears (54) and having an axis of rotation coaxial with the sun gear (52) and carrier (56), wherein the sun gear (52) defines the stationary adjusting member (22).

10. The apparatus (10) of claim 8 further comprising:

a planetary gear assembly (50) having a sun gear (52), a plurality of planet gears (54) rotationally engaging the sun gear (52) and supported for synchronized rotation about the sun gear (52) with a carrier (56), and a ring gear (58) rotationally engaging the plurality of planet gears (54) and having an axis of rotation coaxial with the sun gear (52) and carrier (56), wherein the carrier (56) defines the stationary adjusting member (22).

11. The apparatus (10) of claim 8 further comprising:

a planetary gear assembly (50) having a sun gear (52), a plurality of planet gears (54) rotationally engaging the sun gear (52) and supported for synchronized rotation about the sun gear (52) with a carrier (56), and a ring gear (58) rotationally engaging the plurality of planet gears (54) and having an axis of rotation coaxial with the sun gear (52) and carrier (56), wherein the ring gear (58) defines the stationary adjusting member (22).

12. The apparatus (10) of claim 8 further comprising:

a calibration program (500) for calibrating a position of the stationary adjusting member (22) without running the internal combustion engine including:

moving (502) the electric motor (16) to a first stop position;

moving (504) the electric motor (16) to a second stop position;

recording (506) a range of the electric motor movement; and setting (508) position sensor (30) output to first and second direct current voltage values corresponding to the first and second stop positions.

13. The apparatus (10) of claim 8 further comprising:

a calibration program (600) for calibrating a position of the stationary adjusting member (22) while running the internal combustion engine including:

receiving (602) a stationary adjusting member (22) position sensor (30) signal;

receiving (604) a camshaft position sensor (32) signal;

receiving (606) a crankshaft position sensor (34) signal;

determining (608) if positions are consistent with one another;

if consistent, waiting for another cam phase adjustment command (610); and if not consistent, recalibrating (612) the stationary adjusting member (22) position and rechecking position sensor (30, 32, 34) signals for consistency.

14. The apparatus (10) of claim 8 further comprising:

a control program (400) for controlling a position of the stationary adjusting member (22) including:

determining (402) a position to command the stationary adjusting member (22) to move toward in response to a cam phase adjustment signal;

adjusting (404) the stationary adjusting member (22) position toward the commanded position;

receiving (406) a stationary adjusting member (22) position sensor (30) signal;

determining (408) if the stationary adjusting member (22) is in the commanded position;

if not in the commanded position, continuing (410) movement toward the commanded position; and if in the commanded position, waiting (412) for another cam phase adjustment signal.

15. A method for controlling an angular position of a camshaft (12) in an internal combustion engine having a camshaft phaser (14) for controllably varying a phase relationship between a crankshaft of the internal combustion engine and the camshaft, the camshaft phaser (14) being actuated by an electric motor (16) having an actuator shaft (18) operating through a gear reduction drive train (20) having a stationary adjusting member (22) which rotates when a phase change adjustment is desired but is stationary when the phase relationship between the crankshaft and the camshaft is maintained, the method comprising:

controlling (700) a position of the stationary adjusting member (22) while running the internal combustion engine including:

moving (702) the stationary adjusting member (22) toward a commanded position in response to a cam phase adjustment signal;

receiving (704) a stationary adjusting member position sensor signal from a sensor (30) that is configured to detect the angular position of the stationary adjusting member (22) prior to engine operation;

determining (706) if the stationary adjusting member (22) is in the commanded position based on the stationary adjusting member position sensor signal received from sensor (30);

if not in the commanded position, continuing (708) movement toward the commanded position;

if in the commanded position, receiving (710, 712) a camshaft position sensor signal from a camshaft position sensor (32) and a crankshaft position sensor signal from a crankshaft position sensor (34);

determining (714) if the stationary member position sensor signal, camshaft position sensor signal, and crankshaft position sensor signal are consistent with one another;

if consistent with one another, waiting (716) for another cam phase adjustment command; and if not consistent with one another, recalibrating (718) the stationary adjusting member (22) position and continuing movement of the stationary adjusting member (22) toward the commanded position.

* * * * *